US006196210B1

(12) United States Patent
Chamberlain

(10) Patent No.: US 6,196,210 B1
(45) Date of Patent: Mar. 6, 2001

(54) BOW WITH ARROW STABILIZING PIN AND POROUS ARROW

(76) Inventor: Roger M. Chamberlain, P.O. Box 641, Alburg, VT (US) 05440

( * ) Notice: Subject to any disclaimer, the term of this patent is extended or adjusted under 35 U.S.C. 154(b) by 0 days.

(21) Appl. No.: 09/548,280

(22) Filed: Apr. 12, 2000

(51) Int. Cl.[7] ..... F41B 5/22
(52) U.S. Cl. ..... 124/23.1; 124/35.2; 124/44.5
(58) Field of Search ..... 124/23.1, 24.1, 124/35.2, 44.5, 86

(56) References Cited

U.S. PATENT DOCUMENTS 1,526,176 * 2/1925 O'Connell .
3,158,145 * 11/1964 Handy .
3,561,418 * 2/1971 Fredrickson .
4,407,261 * 10/1983 Elliott .
4,886,039 * 12/1989 Wagner .
5,000,154 * 3/1991 Slayton ..... 124/35.2 X
5,002,035 * 3/1991 Brooks ..... 124/35.2 X
5,065,730 * 11/1991 Kluver ..... 124/35.2
5,143,043 * 9/1992 Brelsford ..... 124/24.1
5,156,138 * 10/1992 Grover ..... 124/35.2
5,671,723 * 9/1997 Goff et al. ..... 124/35.2
5,967,131 * 10/1999 Hervig ..... 124/25.6

* cited by examiner

*Primary Examiner*—John A. Ricci
(74) *Attorney, Agent, or Firm*—John J. Welch, Jr., Esq.

(57) ABSTRACT

The invention is a compound bow with a stabilizing pin affixed to the base of the sight window of the bow at an angle less than 90° with reference to the horizontal lie of the base of the sight window in combination with a porous arrow marked by the presence therein of a through hole in proximity to the tip of the arrow that is amenable upon a pivotable arrow rest component of the bow to being engaged and held statically by the stabilizing pin upon near full extension by an archer of the bowstring of the bow.

4 Claims, 7 Drawing Sheets

BOW WITH ARROW STABILIZING PIN AND POROUS ARROW

CROSS REFERENCES TO PRIOR OR PARENT APPLICATIONS

There are no prior or parent applications to which the instant invention relates.

FEDERALLY SPONSORED RESEARCH AND DEVELOPMENT

There is no federally sponsored research and development to which the instant invention relates.

BACKGROUND OF THE INVENTION

1. Field of the Invention

The instant invention relates to archery devices serving to sustain bowstrings in nearly fully drawn positions without effort expended by an archer.

2. Related Art

The art disclosed in the Information Statement submitted herewith relates to but does not anticipate the instant invention.

A SUMMARY OF THE INVENTION

1. A Brief Description of the Invention

The invention consists of a compound bow equipped with a pivotable arrow rest component and a typical sight window component into the base of which said sight window component there is to be found at its base, a permanently affixed stabilizing pin component. This pin component, an arrow stabilizing pin is thereupon affixed at an angle less than 90° with reference to the horizontal lie of the base of the sight window component of the bow. An arrow with a through hole therein punched is receivable by way of such arrow through hole by the pin component. Any such arrow through hole is located in relatively close proximity to the tip of each arrow. When a bowstring armed with an arrow is drawn back to some 90 to 95% of full extension by an archer pulling with one arm, the archer with the index finger of the hand of the opposite arm, presses the arrow at the situs of the arrow through hole down onto the stabilizing pin component, then releases the tension on the bowstring. When a time comes to launch the arrow, the archer re-engages the bowstring, pulls it back another 5 to 10% to full extension, lifting the index finger as he or she does and notes the arrow coming up off the pin component, whereupon he or she then releases the arrow in the direction of a desired target.

2. Objects of the Invention

An object of the invention is to enable an archer to avoid having to exert the tremendous energy needed to hold a bowstring of a powerful bow to fill extension for a long period of time while patiently awaiting the usually only one-time arrival of target game in the direction of which an arrow would then be launched. As a practical matter, especially with respect to utilization of a compound bow, this holding to full extension for a prolonged period of time can't really be effectively done. Indeed, the noise and commotion involved in otherwise quickly loading an arrow and pulling a bowstring back to full extension upon the arrival of game into a line of sight is such that most of the time, the game while then perceiving such noise and commotion simply bolts, runs and effectively escapes any real exposure to being struck all before such an arrow can even be released to begin with. However, no such noise and commotion occurs when all that is involved is bringing a previously loaded arrow back from rest at 90 to 95% of full extension only another 5 to 10% to full extension before releasing it. Moreover, an inveterate fatigue factor involved in an archer's having to otherwise hold an arrow for a prolonged, indefinite time at full extension is obviated by virtue of resort to utilization of the invention.

Another object of the invention is to facilitate accomplishment of the foregoing in an as ergonomically viable, maintenance free and economically inexpensive a manner as possible without, in any way, altering the manner of release of an arrow. The invention more than merely adequately clearly addresses such a concern, and, in view of its inherent simplicity, much more so than do or would any other art forms ostensibly meant to serve such a purpose.

For the reasons cited above, respectfully submitted, the invention is not only new and unique but unquestionably useful.

A DESCRIPTION OF THE DRAWINGS

A DESCRIPTION OF THE PREFERRED EMBODIMENTS

Figure 1:
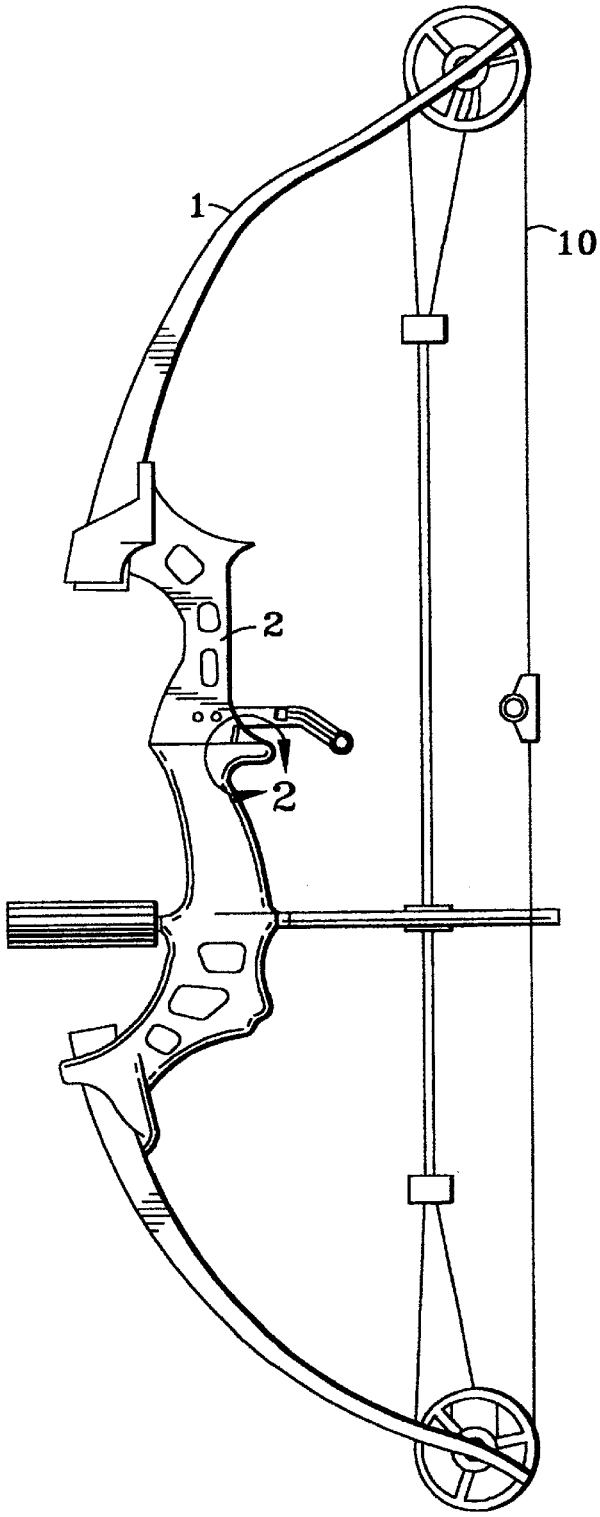
FIG. 1 is a lateral plan view of a typical compound bow equipped with an affixed stabilizing pin component.
Figure 2:
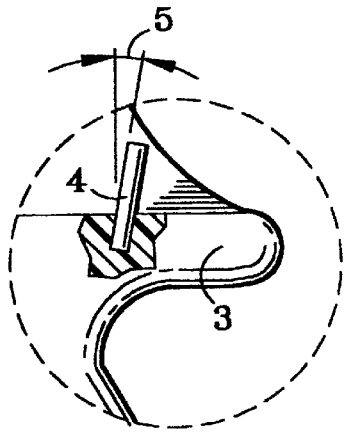
FIG. 2 is an isolated close-up lateral plan view of the stabilizing pin component of the bow of FIG. 1.
Figure 3:
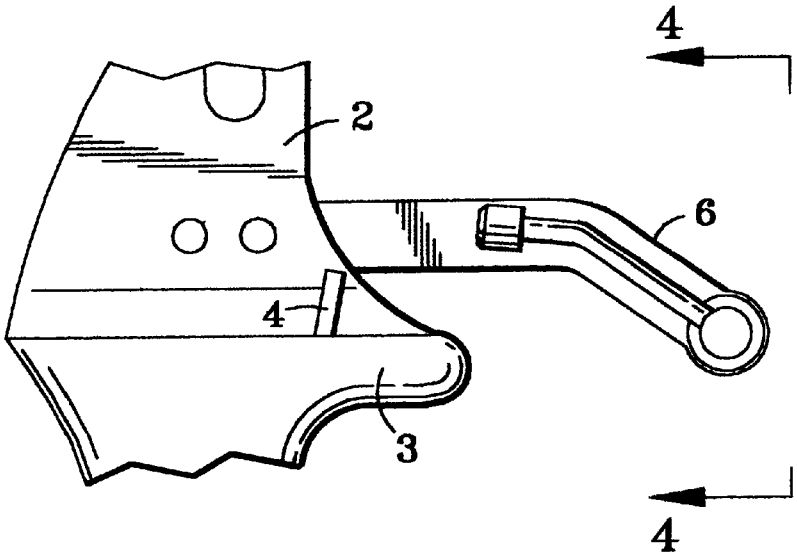
FIG. 3 is an isolated close-up lateral plan view of the stabilizing pin component in apposition to an arrow rest component of the bow of FIG. 1.
Figure 4:
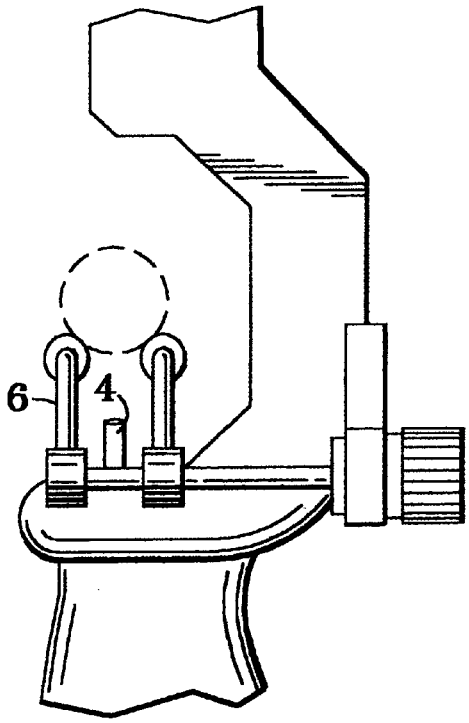
FIG. 4 is an isolated close-up rear plan view of the stabilizing pin component in apposition to an arrow rest component of the bow of FIG. 1.
Figure 5:
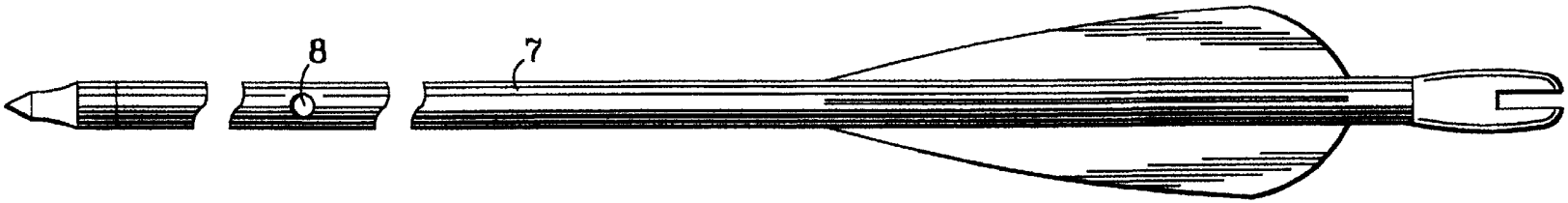
FIG. 5 is a broken bottom plan view of a porous arrow component of the invention.
Figure 6:
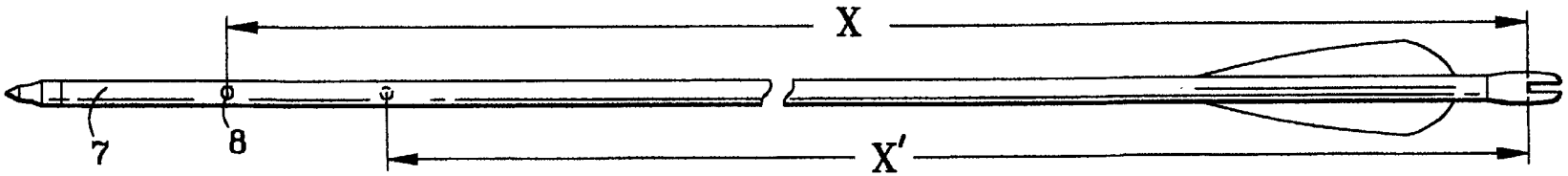
FIG. 6 is a broken bottom plan view of a porous arrow component of the invention illustrating a variation of locations therein of a through hole.
Figure 7:
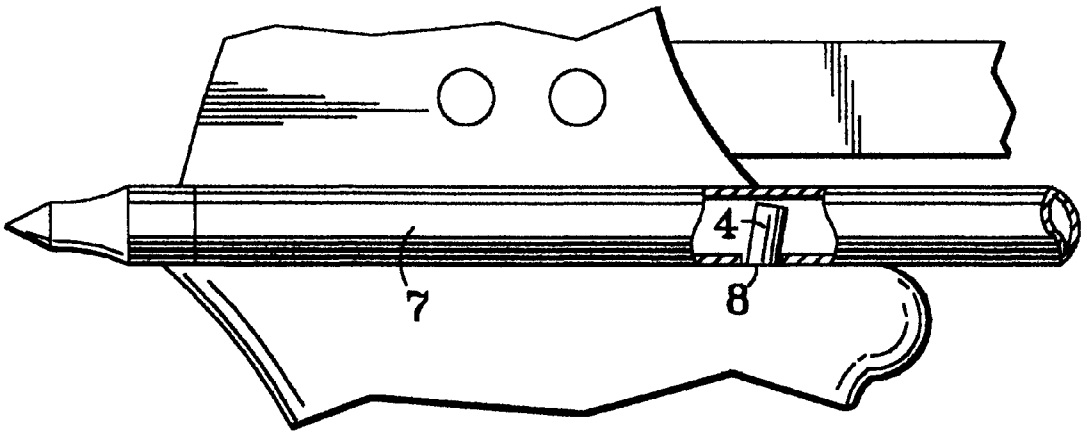
FIG. 7 is an isolated cross-sectional view of the stabilizing pin component of the invention received by a through hole of a porous arrow component of the invention.
Figure 8:
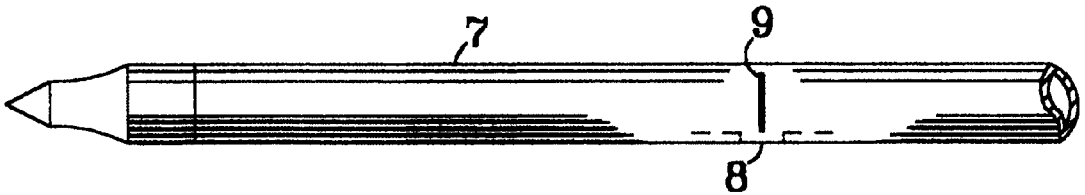
FIG. 8 is an isolated lateral view of a marking on a porous arrow component of the invention at the locus of a through hole therein.
Figure 10:
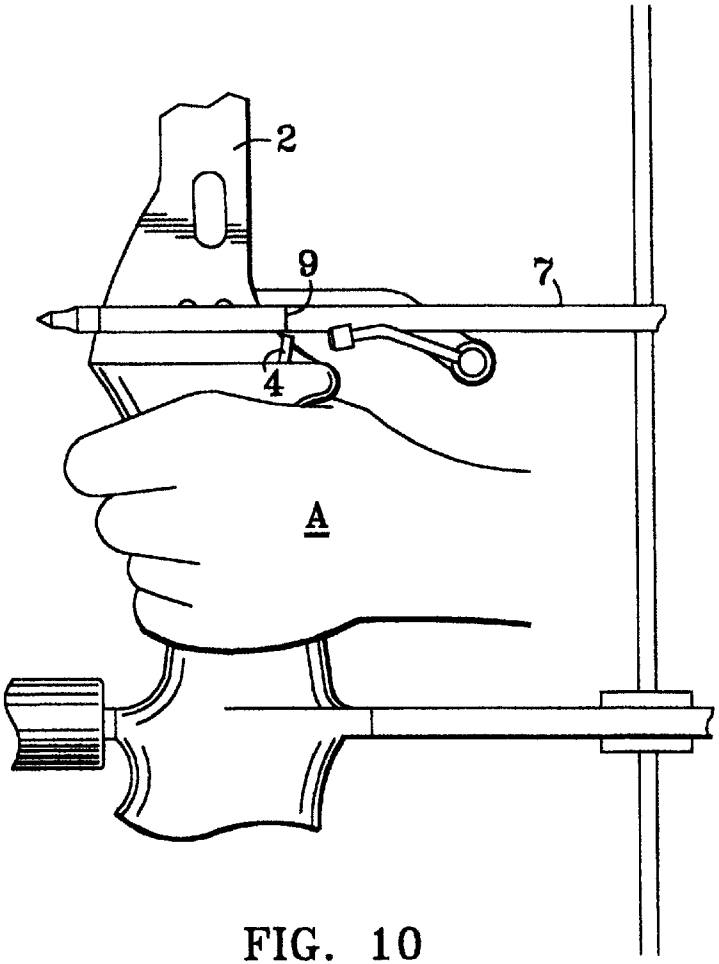
FIG. 10 is an isolated lateral plan view of a porous arrow component being positioned on the stabilizing pin component with a bowstring less extended than as shown in FIG. 9.
Figure 9:
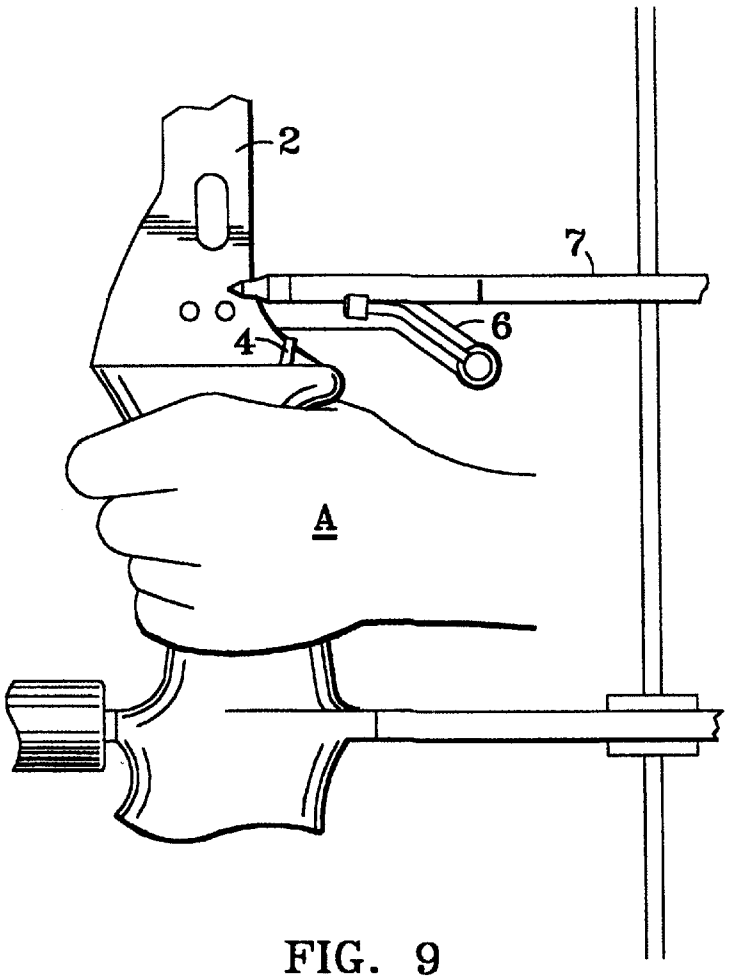
FIG. 9 is an isolated lateral plan view of a porous arrow component being prepared for receipt of the stabilizing pin component with a bowstring extended.
Figure 12:
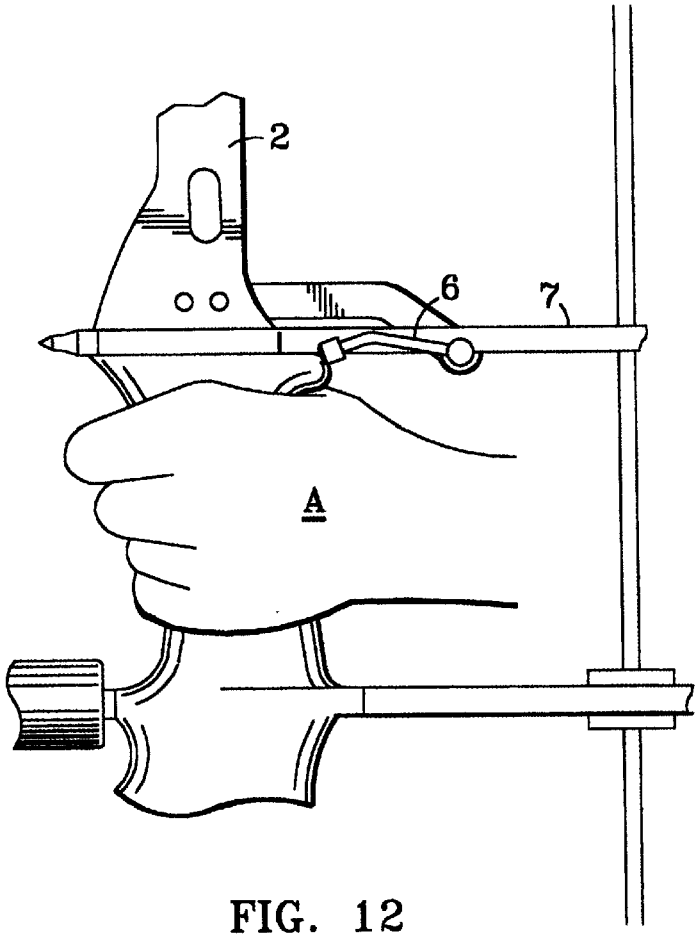
FIG. 12 is an isolated lateral plan view of a porous arrow being held onto the stabilizing pin component just as it is about to be launched.
Figure 11:
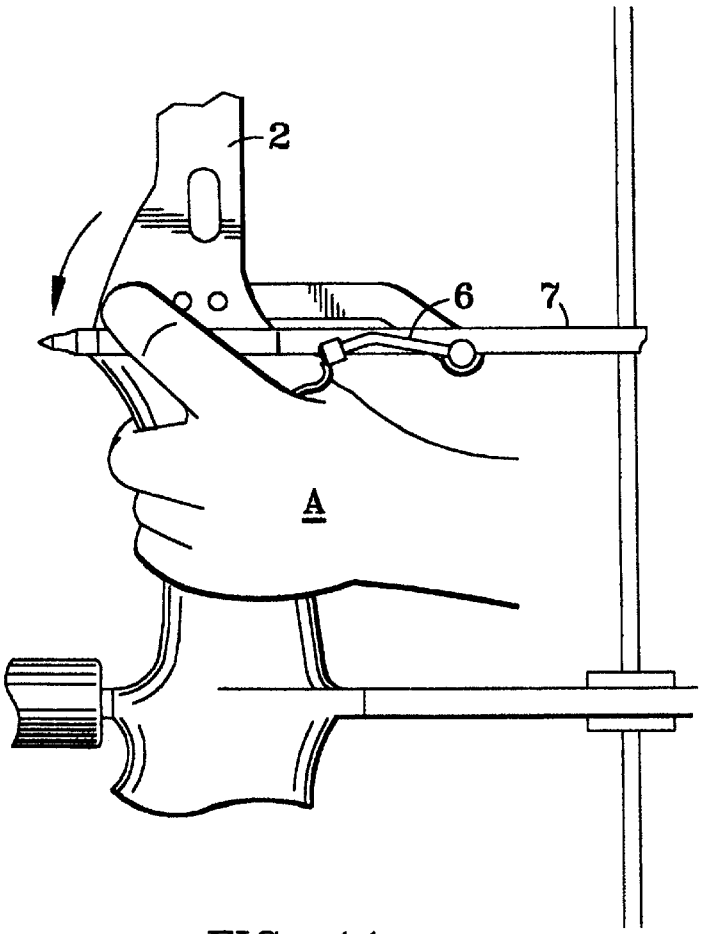
FIG. 11 is an isolated lateral plan view of a porous arrow component being held onto the stabilizing pin component with an archer's index finger.
Figure 13:
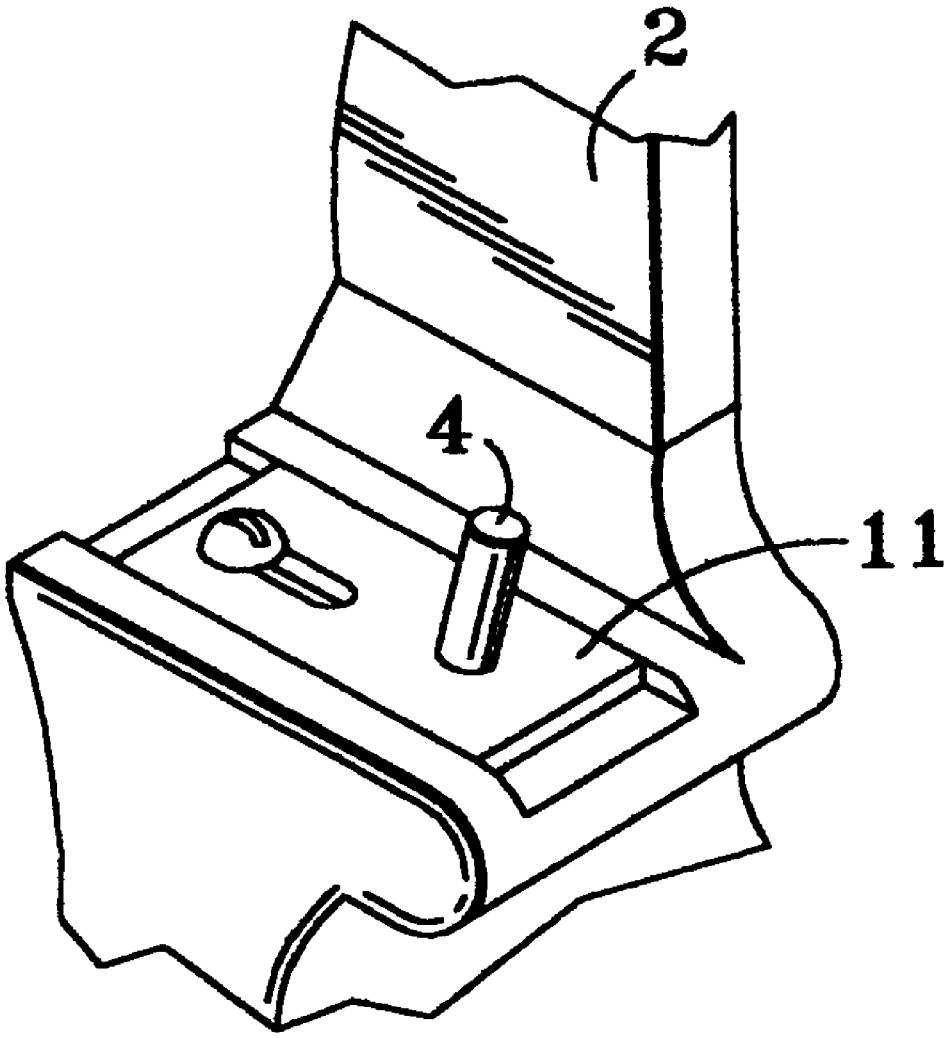
FIG. 13 is an isolated perspective view of a variant form of stabilizing pin component affixed to the base of a sight window component of the bow of FIG. 1 for a second embodiment of the invention.

The invention is a combination bow 1, seen in FIG. 1 to the base 3 of a sight window component 2 thereof, as likewise therein shown, there is affixed at its base 11, an arrow stabilizing pin component 4 as depicted in FIG. 2 and in FIG. 13. FIG. 2 depicts a manner of affixation for a first embodiment of the invention, and FIG. 13 depicts a manner of such affixation for a second embodiment of the invention. Stabilizing pin component 4 is affixed thereto at a first angle 5 which is an angle less than 90° with respect to the horizontal lie of base 3. FIGS. 3 and 4 evidence in plan views the locus of affixed stabilizing pin 4 in relation to the location of a pivotable arrow rest component 6 of bow 1. FIGS. 5 and 6 serve to depict the porous arrow component 7 of the invention which, as shown in FIG. 6, has one through hole 8 in proximity to the tip of porous arrow component 7 either x or x prime units of distance from the tip of porous arrow component 7. Distances, x and x prime serve to accommodate bows 1 of varying sizes and accordingly bowstrings 10 thereof amenable to being drawn back through varying distances respectively. FIG. 7 illustrates the manner in which a stabilizing pin component 4 is receivable by a through hole 8 in porous arrow component 7 and FIG. 8 highlights an etched marking 9 on a porous arrow component 7 to facilitate ready location of through hole 8 therein located by an archer utilizing the invention. FIGS. 9 through 12 inclusive illustrate the manner of use of the invention by an archer. As evidenced by FIG. 9, an archer A pulls back on a bowstring 10 of compound bow 1 with a porous arrow component 7 lying on an arrow rest component 6 and then adjust his or her hand held tension in bowstring 10 until porous arrow component 7 is aligned via etched marking 9 with reference to through hole 8 with stabilizing pin component 4. Once such alignment is accomplished, then, with an index finger of the hand of the archer A holding bow 1 just below the base of sight window component 2 is seen in FIG. 11, porous arrow component 7 is connected via through hole 8 to stabilizing pin component 4. FIG. 12 illustrates how when porous arrow component 7 is to be launched, bowstring 10 of bow 1 is pulled back from a resting position of 90 to 95 percent of full extension to full ex-tension thereby causing porous arrow component 7, once archer A's index finger is removed therefrom as seen in FIG. 12 from its position thereupon as shown in FIG. 11, to lift gently off from stabilizing pin component 4 and thereby be amenable to quick and ready launching as archer A lets go of the bowstring. Through hole 8 has a breadth slightly in excess of the widest breadth of stabilizing pin component 4 so as to facilitate ready and dependable lifting of porous arrow component 7 off from stabilizing pin component 4 upon extension of the bowstring of component bow 1 from 90 to 95% of full extension to full extension as described above.

The invention is especially useful for persons who are physically handicapped. As noted earlier, for the most part, an archer A only gets one shot, as it were, at eligible game and then an archer A, if unsuccessful has to wait, and wait for perhaps a very long time before another opportunity might arise. A handicapped person in an above ground perch seeking to catch game would be at a distinct disadvantage if it were necessary for that person to have to seek to draw a bowstring 10 back to full extension before releasing an arrow. If a bowstring 10 of a compound bow 1 is pulled back to 95 percent of so percent or so of full extension by a healthy colleague of such a person to thereby enable that person to be able to await the arrival of game, that person upon the arrival of same would be able to compete successfully with a health colleague from a standpoint of seeking to catch same simply by resort to use of the invention requiring a drawback of only an additional 5 or so percent to full extension just prior to release. For this reason alone, respectfully submitted, the instant invention is not only new and unique but unquestionably useful.

What is claimed is:

1. A bow with arrow stabilizing pin and porous arrow, comprising:

a. a compound bow equipped with sight window component and pivotable arrow rest component;

b. an arrow stabilizing pin component affixed at a base thereof within a horizontally aligned base of said sight window component, c. said arrow stabilizing pin component being so affixed at an angle less than 90° above a horizontal lie of said horizontally aligned base of said sight window component;

d. a porous arrow component;

e. said porous arrow component being characterized by a presence of a through hole located therein in proximity to a tip end of said porous arrow component, and;

f. said through hole having a breadth slightly in excess of a widest breadth of said arrow stabilizing pin component.

2. The bow with arrow stabilizing pin and porous arrow of claim 1, whereby said arrow stabilizing pin component is cylindrically shaped.

3. The bow with arrow stabilizing pin and porous arrow of claim 2, whereby said arrow stabilizing pin component is cylindrically shaped.

4. A bow with arrow stabilizing pin and porous arrow, comprising:

a. a compound bow equipped with sight window component and pivotable arrow rest component;

b. an arrow stabilizing pin component affixed at a base thereof within a horizontally aligned base of said sight window component;

c. said arrow stabilizing pin component being so affixed at an angle less than 90° above a horizontal lie of said horizontally aligned base of said sight window component;

d. a porous arrow component;

e. said porous arrow component being characterized by a presence of a through hole located therein in proximity to a tip end of said porous arrow component, and;

f. said through hole having a breadth slightly in excess of a widest breadth of said arrow stabilizing pin component, and;

g. a mark etched on one side of said porous arrow component just lateral to said location of said through hole in said porous arrow component.

* * * * *